US006287167B1

(12) United States Patent
Kondo

(10) Patent No.: US 6,287,167 B1
(45) Date of Patent: Sep. 11, 2001

(54) DRIVING CIRCUIT FOR TOY CAR

(75) Inventor: Hirotoshi Kondo, Tokyo (JP)

(73) Assignee: Kondo kagaku Co., Ltd., Tokyo (JP)

( * ) Notice: Subject to any disclaimer, the term of this patent is extended or adjusted under 35 U.S.C. 154(b) by 0 days.

(21) Appl. No.: 09/370,704

(22) Filed: Aug. 9, 1999

(30) Foreign Application Priority Data

Aug. 10, 1998 (JP) ..... 10-236593

(51) Int. Cl.[7] ..... A63H 30/00; A63H 30/04

(52) U.S. Cl. ..... 446/454; 446/456; 446/484; 463/62

(58) Field of Search ..... 446/454, 456, 446/457, 461, 462, 484; 463/6, 62

(56) References Cited

U.S. PATENT DOCUMENTS 3,569,969 * 3/1971 Lemon, Jr. ..... 446/456 X
3,705,387 * 12/1972 Stern et al. ..... 446/454 X
4,080,602 * 3/1978 Hattori et al. ..... 446/454 X
4,143,307 * 3/1979 Hansen et al. ..... 446/454 X
4,275,394 * 6/1981 Mabuchi et al. ..... 446/456 X
4,349,986 * 9/1982 Tsukuda ..... 446/484
4,548,584 * 10/1985 Townsend ..... 446/454 X
4,712,184 * 12/1987 Haugerud ..... 446/454 X

* cited by examiner

*Primary Examiner*—D. Neal Muir
(74) *Attorney, Agent, or Firm*—Dilworth & Barrese LLP.

(57) ABSTRACT

The invention relates to a speed controller able to change a pulse frequency and a pulse width of a pulse signal to control a driving motor. This device is able to change the pulse frequency during the run of the toy car which adjusts the torque of the driving motor in response to the revolution number of the driving motor. The speed controller adjusts the pulse frequency to be large when the pulse width is small, while the pulse frequency is small when the pulse width is large.

20 Claims, 6 Drawing Sheets

DRIVING CIRCUIT FOR TOY CAR

BACKGROUND OF THE INVENTION

1. Field of the Invention

This invention relates to a driving circuit for toy car, and more particularly a drive circuit to control a driving motor based on a throttle open signal from a transmitter.

2. Description of the Prior Art

When the toy car is run by a remote control operation in a circuit, an operator should control a car speed of the toy car in response to a curved course and/or a straight course. When the car speed is controlled, a throttle open degree control lever of a transmitter is operated to change a revolution number of the driving motor mounted on the toy car. It is requested to change a pulse width of a pulse signal which drives the driving motor.

For example, when the car speed is lowered when the toy car curves, a pulse width PW of the pulse signal is lessened, as shown in FIG. 7(*a*) thereby lowering the revolution number of the driving motor. On the other hand, when the speed of the car is raised to run the straight course, its pulse width PW of the pulse signal, as shown in FIG. 7(*b*) is enlarged, to raise the revolution number of the driving motor time, a pulse frequency P(1/f frequency) of the pulse signal is not changed but kept constant.

To this end, each circuit on which the toy car runs, a course lay-out and size of a course vary, and construction of the toy car body varies.

For example, there are often opportunities to use the driving motor of wheels, at a low speed revolution, thereby raising a torque at a low speed revolution high, to be able to run the curve course forcibly.

In a straight course with less curves, there are often opportunities to use the driving motor of the wheels at high speed; it is required to smoothly rotate the motor to raise a revolution efficiency of the motor at high.

For this reason, when the toy car is run on a curved course, the pulse frequency P of the pulse signal to drive the driving motor is preset at high (see solid line g1 in FIG. 8) to raise torque at a low speed revolution (see solid line g1 in FIG. 9).

On the other hand, for relatively straight course with few curves for the car drive, the pulse frequency P of the pulse signal to drive the driving motor is preset low, prior to a run of the car (see dotted line g2 in FIG. 8 graph), to smoothly rotate the motor, to raise revolution efficiency (see dotted line g2 in FIG. 9 graph).

Thus, the driving circuit in the prior art is pre-changed at its pulse frequency to meet the course. When the car is run on the curved course, for example, it is difficult to attain high revolution efficiency with smooth revolution of the motor, on the straight course.

On the other hand, when the car is run on the straight course, it is difficult to raise the torque on the curved course.

SUMMARY OF THE INVENTION

This invention provides a driving circuit for the toy car to enable raising the driving motor torque for runs on a curved course to achieve a forceful run, while on the run on the straight course, the driving motor is smoothly rotated to raise the efficiency of revolution. Thus, all the drawbacks in the prior art are overcome. To achieve said object of this invention, it has a speed controller in the drive circuit to control the revolution number of the driving motor on the toy car for run of the toy car, said speed controller being able to change the pulse frequency and the pulse width of the pulse signal to control the driving motor.

The above driving circuit of this invention has a speed controller by which the pulse frequency and the pulse width of the pulse signal are changed.

Thus, this invention achieves a change of the pulse frequency driving a run of the toy car. Then, the torque of the driving motor is adjustable in response to the revolution number of the driving motor and the smooth rotation of the driving motor in response to the revolution number of the driving motor is achieved. In a preferred embodiment the speed controller enlarges the pulse frequency when the pulse width is lowered, while lowering the pulse frequency when the pulse width is enlarged.

While at a low speed revolution of the driving motor, and the pulse frequency of the pulse signal is enlarged, and the pulse frequency of the pulse signal is lowered when the driving motor rotates at a high speed. For this reason, as the driving motor torque can be enlarged when the toy car is run on a curved course, the toy car can be forcefully run on a curved course. To the contrary, when running on the straight course, the driving motor is smoothly rotated, so that the revolution efficiency of the driving motor is raised.

BRIEF DESCRIPTION OF THE ACCOMPANYING DRAWINGS

DESCRIPTION OF THE PREFERRED EMBODIMENTS

Now, the preferred embodiments of this invention will be hereinafter discussed with reference to the accompanying drawings.

Figure 1:
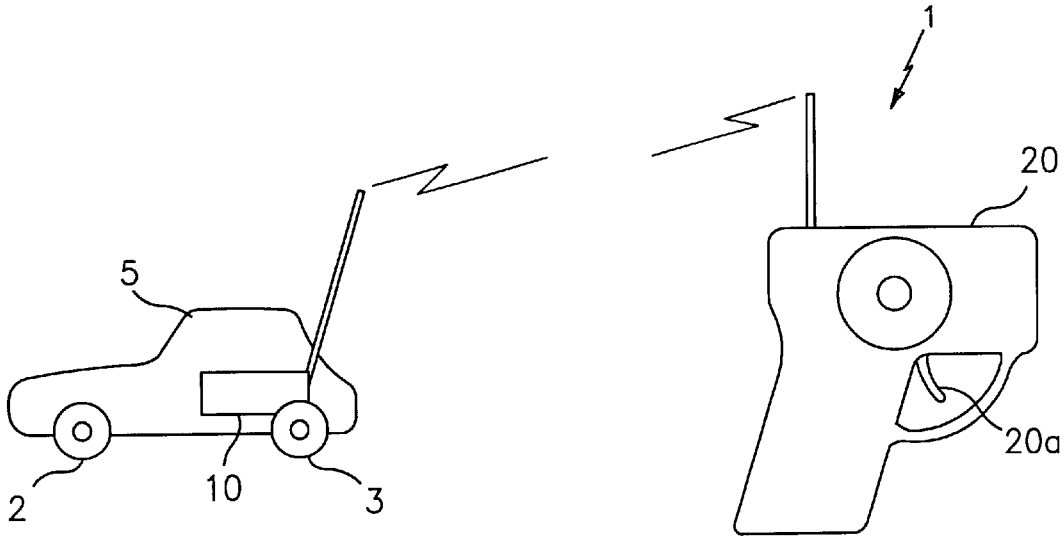
FIG. 1 is a general view showing a toy car unit operated by remote control, of this invention.
Figure 2:
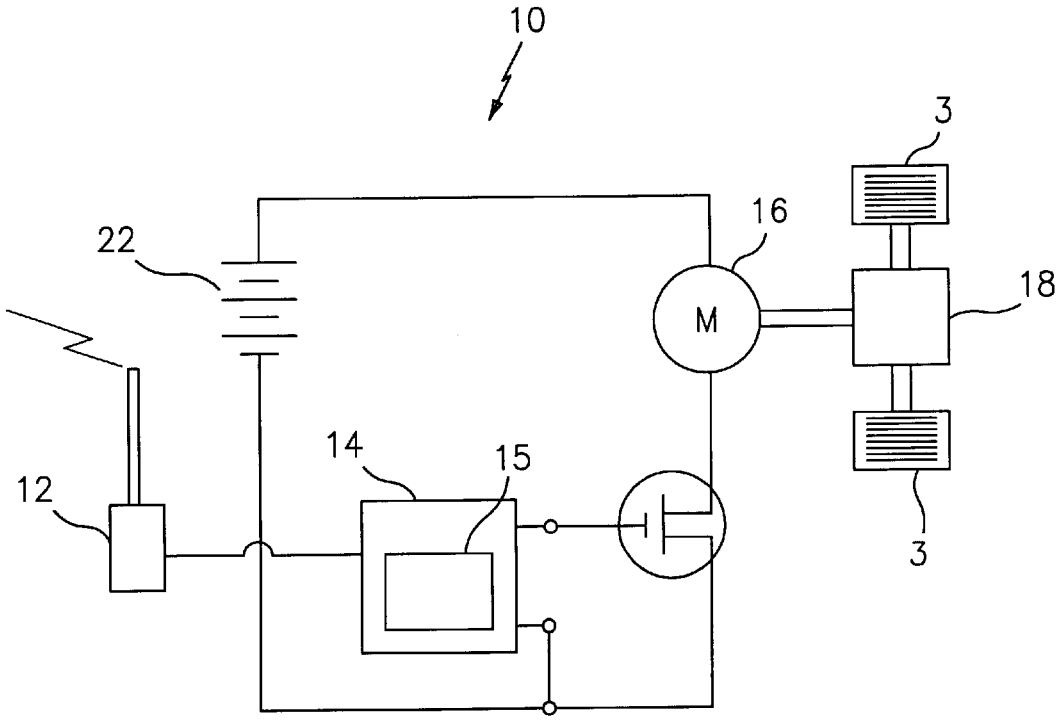
FIG. 2 is a block diagram showing a control means of the toy car of this invention.
Figure 3A:
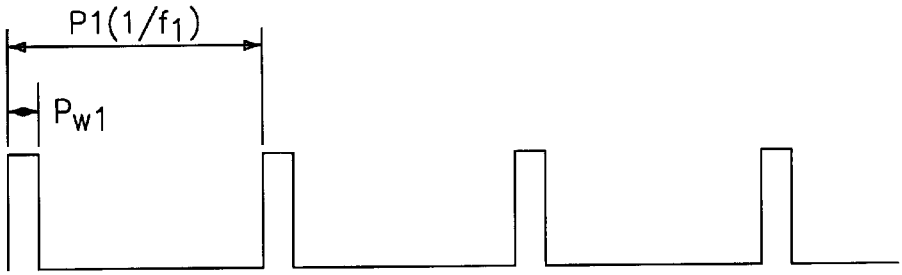
FIG. 3 is a explanatory view of the pulse signal, transmitted to the driving motor from a speed controller, of this invention.
Figure 3B:
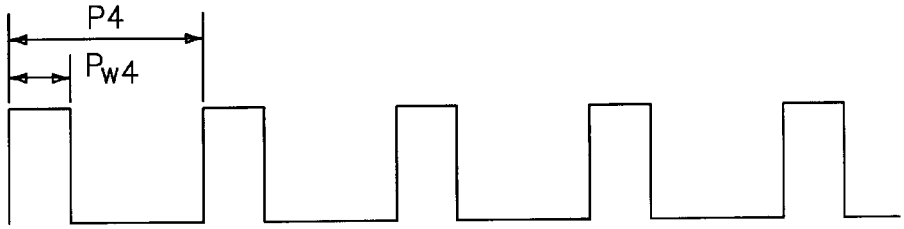
Figure 3C:
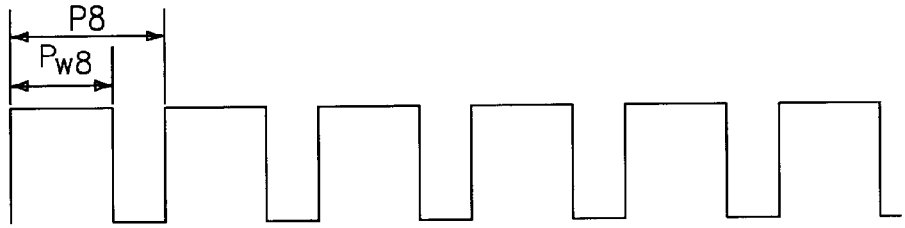
Figure 4:
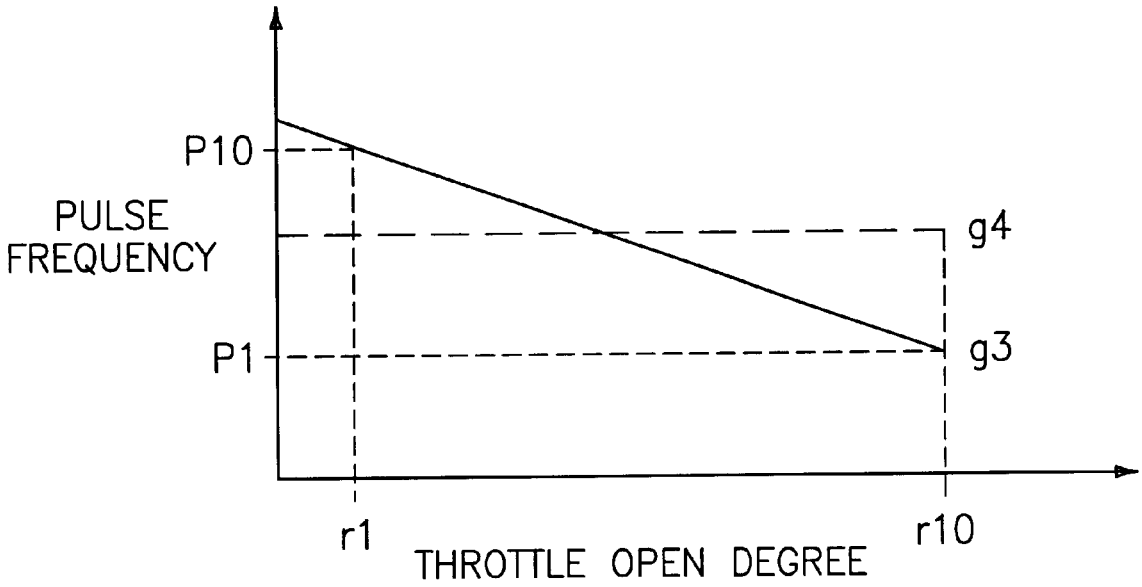
FIG. 4 is a graph showing a relation of a throttle open degree and a pulse frequency, of this invention.
Figure 5:
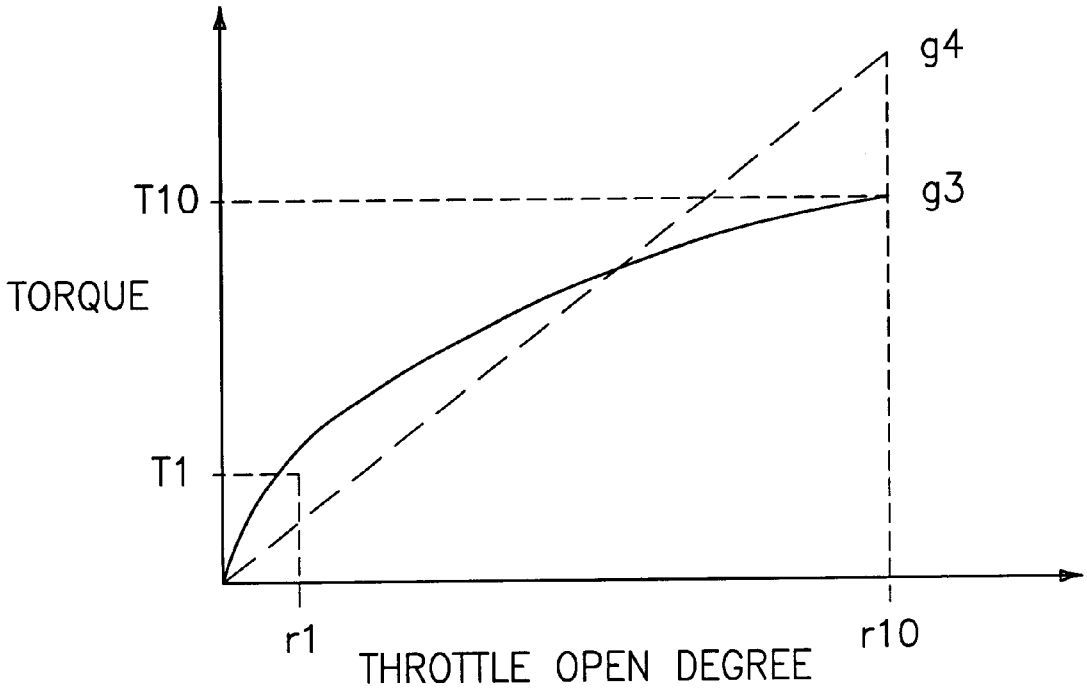
FIG. 5 is a graph showing a relation of the throttle open degree and torque, of this invention.
Figure 6:
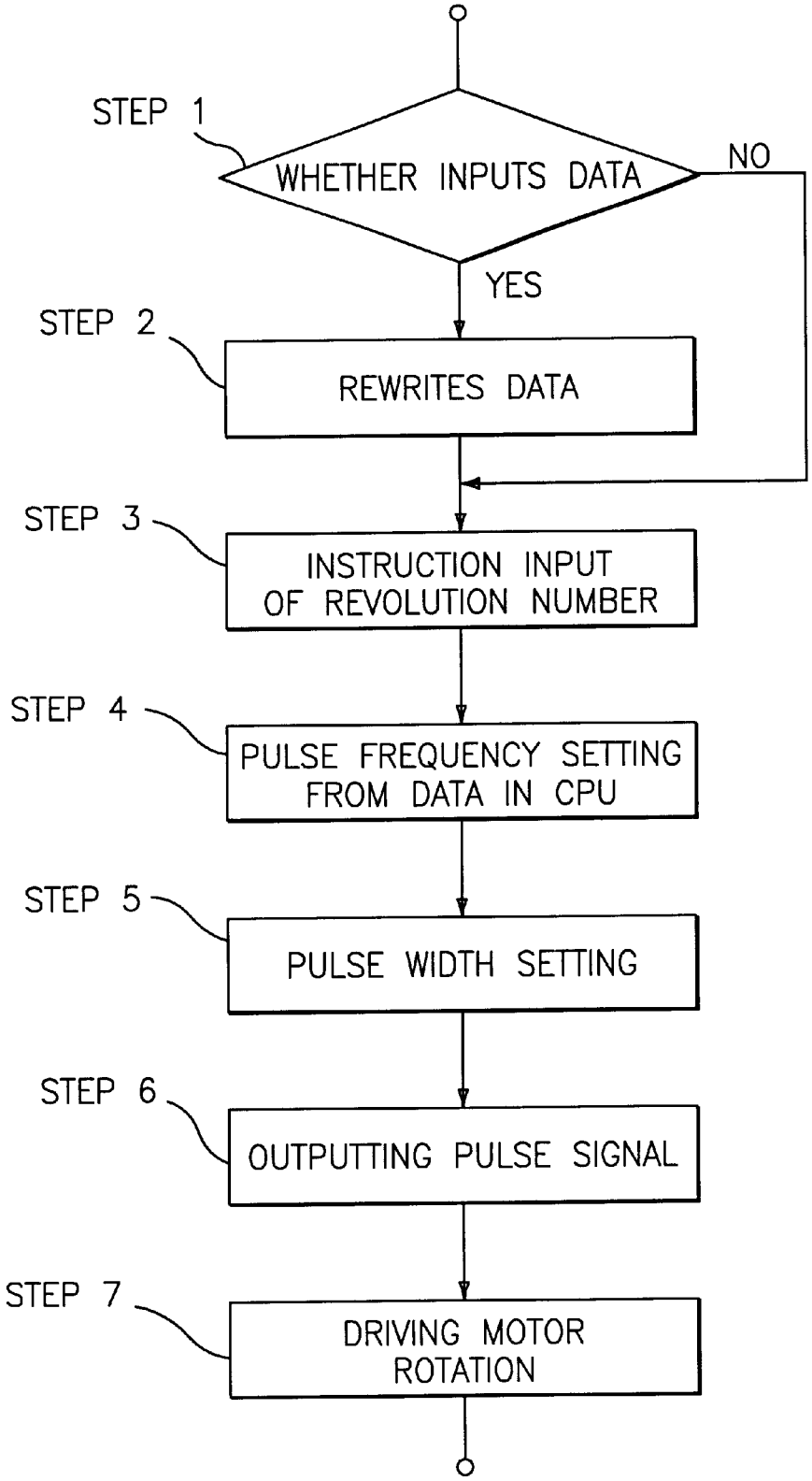
FIG. 6 is a flow chart explaining function of the driving circuit, of this invention.
Figures 7A, 7B:
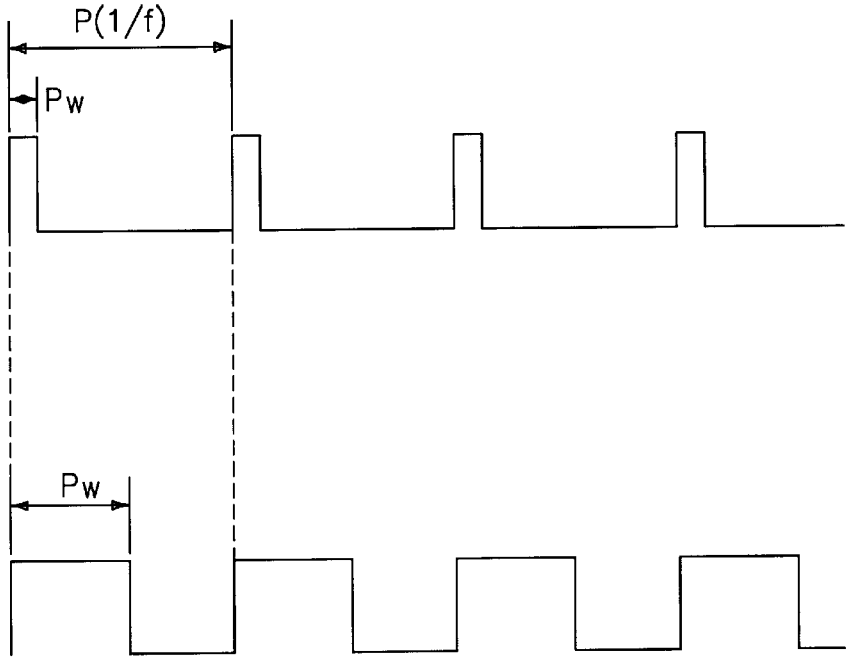
FIG. 7a (PRIOR ART)
FIG. 7b (PRIOR ART)
FIG. 7 is an explanatory view of the pulse signal transmitted to a prior art driving motor.
Figure 8:
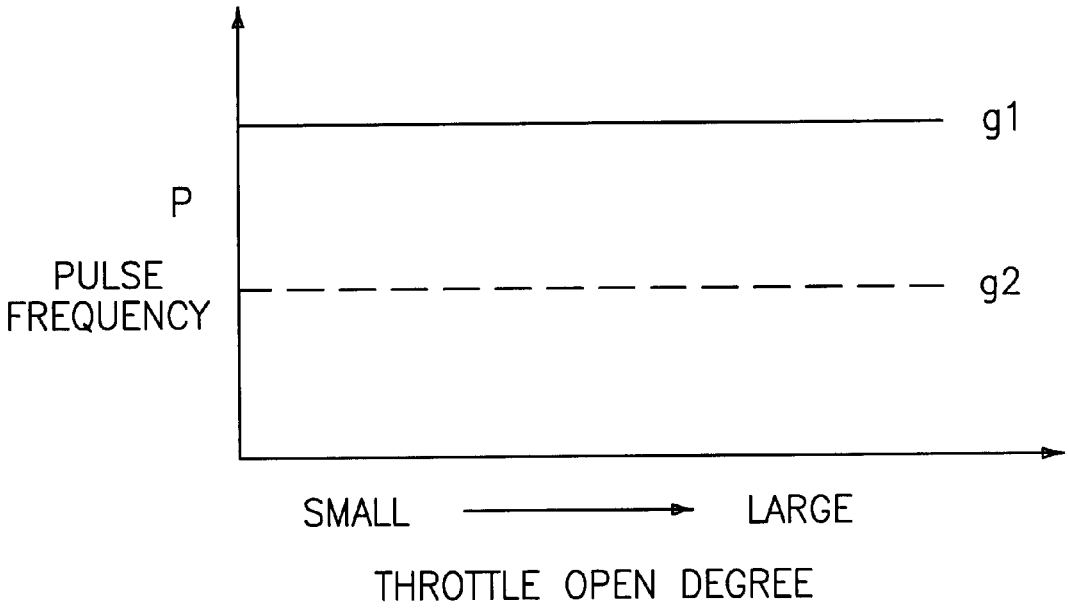
FIG. 8 (PRIOR ART)
FIG. 8 is a graph showing a relation of throttle open degree and pulse frequency, of the prior art.
Figure 9:
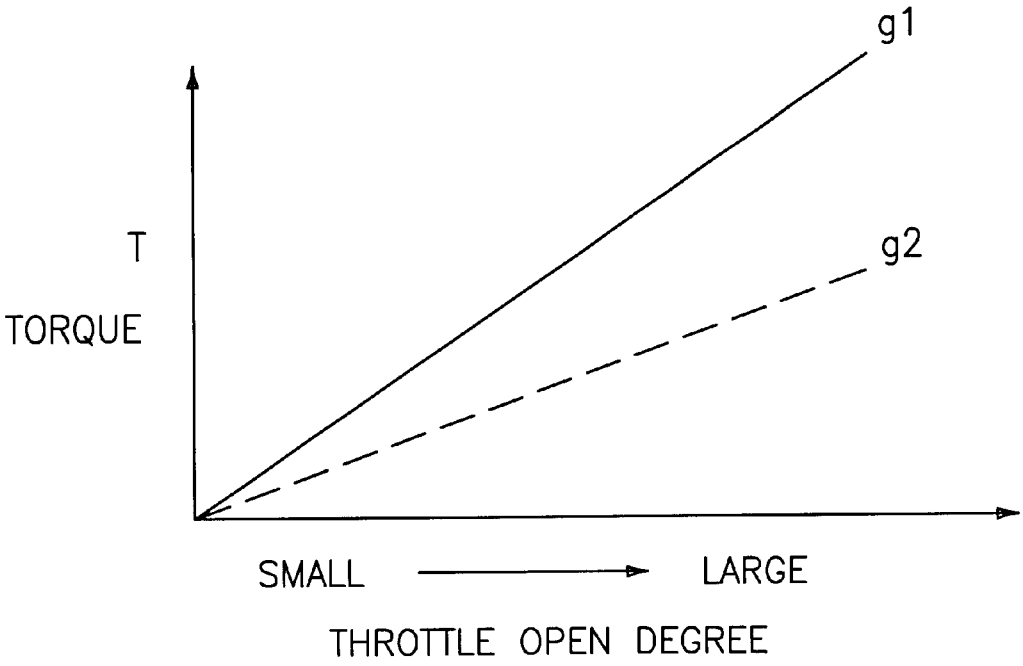
FIG. 9 (PRIOR ART)
FIG. 9 is a graph showing a relation of the throttle open degree and the torque, of the prior art.

FIG. 1 is a general view showing a toy car unit for remote operation of this invention. FIG. 2 is a block diagram showing a control means of the toy car of this invention. FIG. 3 is an explanatory view of a pulse signal transmitted to a driving motor from a speed controller of this invention. FIG. 4 is a graph showing a relation of a throttle open degree and a pulse frequency of this invention. FIG. 5 is a graph showing a throttle open degree and a torque of this invention. FIG. 6 is a flow chart explaining a function of a driving circuit of the toy car of this invention. As shown in FIG. 1, the toy car unit 1 for the remote operation comprises a main body 5 in a toy car shape having front wheels 2 and rear wheels 3, a control means 10 driving the rear wheels 3 of the main body 5, and a transmitter 20 to transmit a running signal to the control means 10.

Numeral 20*a* is a control lever to adjust the throttle open degree at the transmitter 20.

As shown in FIG. 2, the control means 10 comprises a receiver 12 to receive a running signal from the transmitter 20, a driving circuit 14 to a feed speed control signal based on the running signal receiver at the receiver 12, a driving motor 16 driven by a pulse signal (speed control signal) from this driving circuit 14, and a gear member 18 to transmit a revolutionary force of the driving motor 16 to the rear wheels 3. Numeral 22 is a power source. Now, the speed controller 15 is explained based on Table 1. The driving circuit 14 has the speed controller 15 in which data shown in the Table 1 has been input. This data is set in 10 steps of the frequency in f1–f10 of the pulse signal (speed control signal) to control the driving motor 16, with setting a revolution number (the throttle open degree of the control lever) of the driving motor 16 and matching to the revolution number r1–r10 of the driving motor 16.

For example, those frequencies are set in f1:300 Hz, f2:400 Hz, f3:500 Hz, f4:600 Hz, f5:700 Hz, f6:800 Hz, f7:900 Hz, f8:1 KHz, f9:1.5 KHz and f10:2 KHz.

When frequency is set at the frequency f1(300 Hz), a pulse width pw1 is adjustably set at 0–10% of the pulse frequency p1 (1/f1). When the frequency f2 (400 Hz) is set, the pulse width pw2 is adjustably set at 10–20% of the pulse frequency (1/f2); when frequency is set at the frequency f3 (500 Hz), the pulse width pw3 is adjustably set at 20–30% of the pulse frequency p3 (1/f3).

Additionally, when frequency is set at the frequency f4(600 Hz), the pulse width pw4 is adjustably set at 30–40% of the pulse frequency 4 (1/f4), and when frequency is set at the frequency f5 (700 Hz), the pulse width pw5 is adjustably set at 40–50% of the pulse frequency p5 (1/f5). When frequency is set at the frequency f6 (800 Hz), the pulse width pw6 is adjustably set at 50–60% of the pulse frequency p6 (1/f6). When frequency is set at the frequency f7 (900 Hz), the pulse width pw7 is adjustably set at 60–70% of the pulse frequency p7 (1/f7), and when frequency is set at the frequency f8 (1 KHz), the pulse width pw8 is adjustably set at 70–80% of the pulse frequency p1 (1/f8).

Additionally, when frequency is set at the frequency f9 (1.5 KHz), the pulse width pw9 is adjustably set at 80–90% of the pulse frequency and when frequency is set at the frequency f10 (2 KHz), the pulse width pw10 is adjustably set at 90–100% of the pulse frequency p10 (1/f10).

FIG. 3(*a*) shows the pulse frequency p1 (1/f1) and the pulse width pw1, when the frequency is set at f1 (300 Hz). Here, as the pulse frequency p1 is large while the pulse width pw1 is small, the driving motor 16 is able to retain high torque at low speed. FIG. 3(*b*) shows the pulse frequency p4 (1/f4) and the pulse width pw4 when the frequency is set at f4 (600 Hz). Here, as the pulse frequency p1 is medium while the pulse width pw1 is also medium, the driving motor 16 is medium speed.

FIG. 3(*c*) shows the pulse frequency p8 (1/f8 and the pulse width pw8, when the frequency is set at f8 (1 KHz). Here, the driving motor 16 is at high speed and rotates efficiently, as the pulse frequency p1 is small while the pulse width pw8 is large. FIG. 4 shows a relation of the pulse frequency (1–10) based on the data in the Table 1 and revolution number of the driving motor, which is the throttle open degree (r1–r10) of the throttle lever. The pulse frequency (p1–10) is shown at a vertical axis and the throttle open degree (r1–r10) at abscissa.

In FIG. 4, a solid line g3 shows a relation of the pulse frequency and the throttle open degree, of this invention, while a dotted line g4 shows a pulse frequency and a throttle open degree, of the prior art.

The solid line g3 shows that the pulse frequency p1–10 changes in response to the throttle open degree r1–r10. In other words, when the throttle open degree becomes small from r10 to r1, the pulse frequency becomes large from p1 to p10.

On the other hand, when the throttle open degree becomes large from r1 to r10, the pulse frequency becomes small from p10 to p1. In the prior art, the pulse frequency is constant with no change, even when the throttle open degree changes from r1–r10.

FIG. 5 shows a relation of the torque (T1–T10) of the driving motor and the revolution number of the driving motor which is the throttle open degree (r1–r10) of the throttle lever, based on the data in the Table 1.

Here, the torque (T1–T10) is shown in a vertical axis and the throttle open degree (r1–r10) on an abscissa. In FIG. 5, the solid line g3 shows the torque curve of this invention, while the dotted line g4 shows the torque curve in the prior art.

As shown in FIG. 4, as the throttle open degree becomes small from r10–r1, the pulse frequency becomes large from p1 to p10, the torque T1 becomes higher than conventional torque, when the throttle open degree is, for example, small, for example at r1.

On the other hand, when the throttle open degree becomes large from r1 to r10, the pulse frequency becomes small from p10 to p1. When the throttle open degree is large, for example at r10, the torque 10 becomes lower than the conventional torque, but is smoothly rotates the driving motor 16, to raise its revolution efficiency of the driving motor.

Then inputting the data in the Table 1 into the speed controller 15 by the driving circuit 14, to run the toy car 5 based on the data, the flow chart on FIG. 6 is explained.

In the step 1, we judge whether the data in the Table 1 is input or not into the speed controller 15. When the data in the Table 1 is input, an old data of the speed controller is rewritten to the data in the Table 1 (Step 2). On the other hand, when the data in the Table 1 is not input, the old data remaining in the speed controller 15. In this explanation, it is as if the data is rewritten in the data in the Table 1.

If the toy car 5 is caused to run in this state, the revolution number of the driving motor 16 is selected to change the car 5 speed in the step 3, the selected revolution number being instructed from the transmitter 20 to the speed controller 15. In step 4, the pulse frequency is set in response to the input revolution number, based on the data in the Table 1 pre-input in the speed controller 15.

In step 5, the pulse width is set in response to the revolution number. In step 6, the set pulse frequency and the pulse signal set at the pulse width is output from the speed controller 15 to the driving motor 16 which is in turn driven in step 7, to run the toy car 5 at a given car speed.

For example, where the revolution number of the driving motor is at r1, the pulse frequency is at p1 as shown in the Table 1, and the pulse width pw1 is set at a low speed run of 0–10% of the pulse frequency. Thus, as the pulse frequency of the pulse signal is settable at large value, the torque T1 of the driving motor at the low speed (revolution number r1) is settable as shown by the solid line g3 in the FIG. 5. Where the revolution number of the driving motor is set at r4, the pulse frequency is at p4, as shown in the Table 1, the pulse width pw4 is set at medium speed run of 40–50% of the pulse frequency.

Furthermore, where the revolution number is at r10, the pulse frequency is set at p10, as shown in the Table 1, and the pulse width pw10 is set at a high speed run of 90–100% of the pulse frequency.

Thus, as the pulse frequency is settable low, the driving motor 16 is smoothly rotated at the high speed run (revolution number r10), as shown by the solid line g3 in FIG. 5, to raise the revolution efficiency.

In the embodiment aforementioned, although the data in the Table 1 (when the throttle open degree become small, the pulse frequency becomes large, while when the throttle open degree become large, the pulse frequency becomes small), is input into the speed controller 15, it is possible to input the data reverse to the relation of the throttle open degree and the pulse frequency. In the case where the data in the Table 1 is pre-input into the speed controller 15, new data is inputtable from a keyboard, during the running of the toy car 5.

As above, the invention provides a speed controller by which the pulse frequency and the pulse width of the pulse signal are changeable, so that the pulse frequency is changeable during the car running. Therefore, the torque of the driving motor is adjustable in response to the revolution number of the driving motor, while the driving motor is smoothly rotatable in response to the revolution number of the driving motor. Thus, the car runs in response to the states of the course.

What is claimed is:

1. A driving circuit of the toy car to run with a control of a revolution number of a D.C. driving motor mounted on the toy car main body wherein said driving circuit has a speed controller being able to change a pulse frequency and a pulse width of the pulse signal controlling the driving motor.

2. A driving circuit of the toy car according to claim 1, wherein said speed controller is designed so that its pulse frequency is enlarged when the pulse width is decreased and the pulse frequency is decreased when the pulse width is enlarged.

3. A driving circuit according to claim 2, wherein said speed controller is designed such that at a low speed revolution of the driving motor, the pulse frequency of the pulse signal is enlarged, and the pulse frequency of the pulse signal is lowered when the driving motor rotates at a high speed.

4. A driving circuit according to claim 3, wherein the toy car comprises a main body having front wheels and rear wheels, control means for driving the rear wheels of the main body, and a separate transmitter arranged to transmit a running signal to the control means and comprising a control lever for adjusting throttle open degree at the transmitter.

5. A driving circuit according to claim 4, wherein said control means comprise a receiver to receive the signal from the transmitter, a driving circuit arranged to feed a speed control signal based upon the signal received from the receiver, the driving motor arranged to be driven by the pulse signal (speed control signal) from the driving circuit, and a gear member arranged to transmit revolutionary force from the driving motor to the rear wheels.

6. A driving circuit according to claim 3, wherein said speed controller comprises a receiver to receive a running signal from a transmitter, a driving circuit arranged to feed a speed control signal based upon the signal received from the receiver, the driving motor arranged to be driven by the pulse signal (speed control signal) from the driving circuit, and a gear member arranged to transmit revolutionary force from the driving motor to rear wheels.

7. A driving circuit according to claim 2, wherein said speed controller comprises a receiver to receive a running signal from a transmitter, a driving circuit arranged to feed a speed control signal based upon the signal received from the receiver, the driving motor arranged to be driven by the pulse signal (speed control signal) from the driving circuit, and a gear member arranged to transmit revolutionary force from the driving motor to rear wheels.

8. A driving circuit according to claim 1, wherein said speed controller comprises a receiver to receive a running signal from a transmitter, a driving circuit arranged to feed a speed control signal based upon the signal received from the receiver, the driving motor arranged to be driven by the pulse signal (speed control signal) from the driving circuit, and a gear member arranged to transmit revolutionary force from the driving motor to rear wheels.

9. A driving circuit according to claim 8, wherein said speed controller comprises pulse width data input therein in ten steps of frequency of the pulse signal (speed control signal) for controlling the driving motor, with a revolution number (throttle open degree) of the driving motor being set to match the ten frequency steps.

10. A driving circuit according to claim 7, wherein said speed controller comprises pulse width data input therein in ten steps of frequency of the pulse signal (speed control signal) for controlling the driving motor, with a revolution number (throttle open degree) of the driving motor being set to match the ten frequency steps.

11. A driving circuit according to claim 6, wherein said speed controller comprises pulse width data input therein in ten steps of frequency of the pulse signal (speed control signal) for controlling the driving motor, with a revolution number (throttle open degree) of the driving motor being set to match the ten frequency steps.

12. A driving circuit according to claim 5, wherein said control means comprise pulse width data input therein in ten steps of frequency of the pulse signal (speed control signal) for controlling the driving motor, with a revolution number (throttle open degree) of the driving motor being set to match the ten frequency steps.

13. A driving circuit according to claim 12, wherein in the ten steps of the pulse width data, a first step is set up to 10% of the pulse frequency, a second step from 10–20% of the pulse frequency, a third step from 20–30% of the pulse frequency, a fourth step from 30–40% of the pulse frequency, a fifth step from 40–50% of the pulse frequency, a sixth step from 50–60% of pulse frequency, a seventh step from 60–70% of the pulse frequency, an eighth step from 70–80% of the pulse frequency, a ninth step from 80–90% of the pulse frequency and a tenth step from 90–100% of the pulse frequency.

14. A driving circuit according to claim 11, wherein in the ten steps of the pulse width data, a first step is set up to 10% of the pulse frequency, a second step from 10–20% of the pulse frequency, a third step from 20–30% of the pulse frequency, a fourth step from 30–40% of the pulse frequency, a fifth step from 40–50% of the pulse frequency, a sixth step from 50–60% of pulse frequency, a seventh step from 60–70% of the pulse frequency, an eighth step from 70–80% of the pulse frequency, a ninth step from 80–90% of the pulse frequency and a tenth step from 90–100% of the pulse frequency.

15. A driving circuit according to claim 11, wherein in the ten steps of the pulse width data, a first step is set up to 10% of the pulse frequency, a second step from 10–20% of the pulse frequency, a third step from 20–30% of the pulse frequency, a fourth step from 30–40% of the pulse frequency, a fifth step from 40–50% of the pulse frequency, a sixth step from 50–60% of pulse frequency, a seventh step from 60–70% of the pulse frequency, an eighth step from 70–80% of the pulse frequency, a ninth step from 80–90% of the pulse frequency and a tenth step from 90–100% of the pulse frequency.

16. A driving circuit according to claim 15, comprising a decreasing linear relationship between the pulse frequency and the throttle open degree, with the throttle open degree becoming smaller when the pulse frequency becomes larger and vice versa.

17. A driving circuit according to claim 9, comprising a decreasing linear relationship between the pulse frequency and the throttle open degree, with the throttle open degree becoming smaller when the pulse frequency becomes larger and vice versa.

18. A driving circuit according to claim 17, wherein the torque of the driving motor and revolution number or throttle open degree of the driving motor comprising a positive curvilinear relationship with each other that increases towards a limit of torque as the torque and throttle open degree both increase.

19. A driving circuit according to claim 6, wherein the torque of the driving motor and revolution number or throttle open degree of the driving motor comprising a positive curvilinear relationship with one another that increases towards a limit of torque as the torque and throttle open degree both increase.

20. A driving circuit according to claim 5, wherein the torque of the driving motor and revolution member or throttle open degree of the driving motor comprising a positive curvilinear relationship that increases towards a limit of torque as the torque and throttle open degree both increase.

* * * * *